US007350584B2

(12) United States Patent
Simpson et al.

(10) Patent No.: US 7,350,584 B2
(45) Date of Patent: Apr. 1, 2008

(54) FORMED TUBULARS

(75) Inventors: Neil Andrew Abercrombie Simpson, Scotland (GB); Simon John Harrall, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 208 days.

(21) Appl. No.: 10/614,427

(22) Filed: Jul. 7, 2003

(65) Prior Publication Data

US 2005/0000697 A1 Jan. 6, 2005

(30) Foreign Application Priority Data

Jul. 6, 2002 (GB) ..... 0215659.4

(51) Int. Cl.
*E21B 23/00* (2006.01)

(52) U.S. Cl. ..... 166/380; 166/384; 166/207

(58) Field of Classification Search ..... 166/380, 166/384, 207

See application file for complete search history.

(56) References Cited

U.S. PATENT DOCUMENTS 1,301,285 A 4/1919 Leonard
1,494,128 A * 5/1924 Primrose ..... 72/370.08
1,654,600 A * 1/1928 Powell
1,827,437 A * 10/1931 Pascoe ..... 228/136
1,880,218 A * 10/1932 Simmons ..... 166/382
1,881,379 A * 10/1932 Shipley et al.
1,896,112 A 2/1933 Simmons
2,246,418 A * 6/1941 Froome et al. ..... 175/323
2,402,497 A * 6/1946 Johnson ..... 138/135
2,840,897 A * 7/1958 Ingalls ..... 228/153
2,999,552 A 9/1961 Fox
3,194,331 A 7/1965 Arnold
3,203,451 A 8/1965 Vincent
3,254,508 A * 6/1966 Garrett ..... 464/20
3,277,231 A * 10/1966 Downey et al. ..... 174/47
3,297,092 A * 1/1967 Jennings
3,554,308 A * 1/1971 Ditson ..... 175/395
4,261,671 A * 4/1981 Langner ..... 405/166
4,336,849 A * 6/1982 Hug ..... 175/246
4,360,493 A * 11/1982 Kramer et al. ..... 264/506
4,482,086 A 11/1984 Wagner et al.
4,566,495 A 1/1986 Baker et al.
4,726,711 A * 2/1988 Tian ..... 405/184
4,831,346 A * 5/1989 Brooker et al. ..... 33/260

(Continued)

FOREIGN PATENT DOCUMENTS

GB 2155830 10/1985

(Continued)

OTHER PUBLICATIONS

PCT Search Report, International Application No. PCT/GB 03/02880, dated Nov. 20, 2003.

(Continued)

*Primary Examiner*—William P Neuder
(74) *Attorney, Agent, or Firm*—Patterson & Sheridan, L.L.P.

(57) ABSTRACT

A method of lining a drilled bore comprises running a tubular into a drilled bore and then corrugating the tubular in the bore. The tubular may also be expanded in the bore. In other aspects of the invention the tubular is corrugated prior to running into the bore and may be rotated as it is run into the bore.

97 Claims, 5 Drawing Sheets

U.S. PATENT DOCUMENTS

| | | | | |
|---|---|---|---|---|
| 5,026,209 | A | 6/1991 | Titmas et al. | |
| 5,040,620 | A | 8/1991 | Nunley | |
| 5,174,340 | A | 12/1992 | Peterson | |
| 5,275,240 | A | 1/1994 | Peterson | |
| 5,358,358 | A * | 10/1994 | Tassone et al. | 405/154.1 |
| 5,785,120 | A | 7/1998 | Smalley et al. | |
| 5,794,702 | A * | 8/1998 | Nobileau | 166/380 |
| 5,901,789 | A | 5/1999 | Donnelly et al. | |
| 5,921,285 | A * | 7/1999 | Quigley et al. | 138/125 |
| 5,924,745 | A | 7/1999 | Campbell | |
| 5,927,344 | A | 7/1999 | Nobileau | |
| 6,016,845 | A * | 1/2000 | Quigley et al. | 138/125 |
| 6,065,500 | A | 5/2000 | Metcalfe | |
| 6,073,692 | A * | 6/2000 | Wood et al. | 166/187 |
| 6,092,602 | A | 7/2000 | Gano | |
| 6,098,717 | A | 8/2000 | Bailey et al. | |
| 6,112,818 | A | 9/2000 | Campbell | |
| 6,142,230 | A | 11/2000 | Smalley et al. | |
| 6,148,866 | A * | 11/2000 | Quigley et al. | 138/125 |
| 6,253,850 | B1 | 7/2001 | Nazzai et al. | |
| 6,322,109 | B1 | 11/2001 | Campbell et al. | |
| 6,352,148 | B1 | 3/2002 | Hindemith | |
| 6,409,226 | B1 | 6/2002 | Slack et al. | |
| 6,425,444 | B1 | 7/2002 | Metcalfe et al. | |
| 6,431,610 | B1 * | 8/2002 | Ohirano et al. | 285/32 |
| 6,454,007 | B1 | 9/2002 | Bailey | |
| 6,454,013 | B1 | 9/2002 | Metcalfe | |
| 6,457,518 | B1 | 10/2002 | Castano-Mears et al. | |
| 6,457,532 | B1 | 10/2002 | Simpson | |
| 6,457,533 | B1 | 10/2002 | Metcalfe | |
| 6,460,616 | B1 | 10/2002 | Simpson | |
| 6,510,896 | B2 | 1/2003 | Bode et al. | |
| 6,513,588 | B1 | 2/2003 | Metcalfe | |
| 6,527,049 | B2 | 3/2003 | Metcalfe et al. | |
| 6,536,525 | B1 | 3/2003 | Haugen et al. | |
| 6,543,552 | B1 | 4/2003 | Metcalfe et al. | |
| 6,550,539 | B2 | 4/2003 | Maguire et al. | |
| 6,571,672 | B1 | 6/2003 | Rudd | |
| 6,571,871 | B2 | 6/2003 | Lauritzen et al. | |
| 6,578,630 | B2 | 6/2003 | Simpson et al. | |
| 6,585,053 | B2 | 7/2003 | Coon | |
| 6,591,905 | B2 | 7/2003 | Coon | |
| 6,598,678 | B1 | 7/2003 | Simpson et al. | |
| 6,604,550 | B2 * | 8/2003 | Quigley et al. | 138/125 |
| 6,629,567 | B2 | 10/2003 | Lauritzen et al. | |
| 6,648,075 | B2 | 11/2003 | Badrak et al. | |
| 6,662,876 | B2 | 12/2003 | Lauritzen | |
| 6,668,930 | B2 | 12/2003 | Hoffman | |
| 6,685,236 | B2 | 2/2004 | Setterberg, Jr. | |
| 6,688,395 | B2 | 2/2004 | Maguire et al. | |
| 6,688,399 | B2 | 2/2004 | Maguire et al. | |
| 6,688,400 | B2 | 2/2004 | Metcalfe et al. | |
| 6,691,789 | B2 | 2/2004 | Jackson et al. | |
| 6,695,063 | B2 | 2/2004 | Lauritzen et al. | |
| 6,695,065 | B2 | 2/2004 | Simpson et al. | |
| 6,698,517 | B2 | 3/2004 | Simpson et al. | |
| 6,702,029 | B2 | 3/2004 | Metcalfe et al. | |
| 6,702,030 | B2 | 3/2004 | Simpson et al. | |
| 6,708,762 | B2 | 3/2004 | Haugen et al. | |
| 6,708,767 | B2 | 3/2004 | Harrall et al. | |
| 6,708,769 | B2 | 3/2004 | Haugen et al. | |
| 6,712,142 | B2 | 3/2004 | Simpson et al. | |
| 6,712,151 | B2 | 3/2004 | Simpson et al. | |
| 6,722,441 | B2 | 4/2004 | Lauritzen et al. | |
| 6,722,442 | B2 | 4/2004 | Simpson | |
| 6,722,443 | B1 | 4/2004 | Metcalfe | |
| 6,725,917 | B2 | 4/2004 | Metcalfe | |
| 6,732,806 | B2 | 5/2004 | Mauldin et al. | |
| 6,742,591 | B2 | 6/2004 | Metcalfe | |
| 6,742,598 | B2 | 6/2004 | Whitelaw et al. | |
| 6,742,606 | B2 | 6/2004 | Metcalfe et al. | |
| 6,745,839 | B1 | 6/2004 | Simpson | |
| 6,745,841 | B2 | 6/2004 | Simpson | |
| 6,745,846 | B1 | 6/2004 | Innes et al. | |
| 6,752,215 | B2 | 6/2004 | Maguire et al. | |
| 6,752,216 | B2 | 6/2004 | Coon | |
| 6,758,275 | B2 | 7/2004 | Martin | |
| 6,782,953 | B2 | 8/2004 | Maguire et al. | |
| 6,789,622 | B1 | 9/2004 | Ducasse et al. | |
| 6,789,822 | B1 | 9/2004 | Metcalfe | |
| 6,805,196 | B2 | 10/2004 | Lawrence | |
| 6,820,687 | B2 | 11/2004 | Maguire et al. | |
| 6,832,649 | B2 | 12/2004 | Bode et al. | |
| 6,834,725 | B2 | 12/2004 | Whanger et al. | |
| 6,840,325 | B2 | 1/2005 | Stephenson | |
| 6,843,319 | B2 | 1/2005 | Tran et al. | |
| 6,845,820 | B1 | 1/2005 | Hebert et al. | |
| 6,851,475 | B2 | 2/2005 | Simpson et al. | |
| 6,866,100 | B2 | 3/2005 | Gudmestad et al. | |
| 6,868,905 | B2 | 3/2005 | Lauritzen et al. | |
| 6,877,553 | B2 | 4/2005 | Cameron | |
| 6,896,052 | B2 | 5/2005 | Simpson et al. | |
| 6,896,057 | B2 | 5/2005 | Metcalfe | |
| 6,899,181 | B2 | 5/2005 | Simpson et al. | |
| 6,902,000 | B2 | 6/2005 | Simpson et al. | |
| 6,907,937 | B2 | 6/2005 | Whanger et al. | |
| 6,910,388 | B2 | 6/2005 | Jones | |
| 6,920,932 | B2 | 7/2005 | Zimmerman | |
| 6,920,934 | B2 | 7/2005 | Badrak et al. | |
| 6,920,935 | B2 | 7/2005 | Metcalfe | |
| 6,923,261 | B2 | 8/2005 | Metcalfe et al. | |
| 6,932,161 | B2 | 8/2005 | Cameron | |
| 6,935,429 | B2 | 8/2005 | Badrak | |
| 6,935,430 | B2 | 8/2005 | Harrall et al. | |
| 6,938,694 | B2 | 9/2005 | Rudd | |
| 6,942,029 | B2 | 9/2005 | Simpson | |
| 6,953,086 | B2 | 10/2005 | Simpson | |
| 6,953,096 | B2 | 10/2005 | Gledhill et al. | |
| 6,966,369 | B2 | 11/2005 | Harrall et al. | |
| 6,968,896 | B2 | 11/2005 | Coon | |
| 6,976,536 | B2 | 12/2005 | Simpson et al. | |
| 6,976,539 | B2 | 12/2005 | Metcalfe et al. | |
| 6,981,547 | B2 | 1/2006 | Maguire et al. | |
| 6,988,557 | B2 | 1/2006 | Whanger et al. | |
| 6,991,040 | B2 | 1/2006 | Hill, Jr. et al. | |
| 6,997,264 | B2 | 2/2006 | Simpson et al. | |
| 6,997,266 | B2 | 2/2006 | Jackson et al. | |
| 7,004,257 | B2 | 2/2006 | Simpson et al. | |
| 7,004,264 | B2 | 2/2006 | Simpson et al. | |
| 7,011,162 | B2 | 3/2006 | Maguire | |
| 7,017,669 | B2 | 3/2006 | Johnston et al. | |
| 7,025,135 | B2 | 4/2006 | Ellington et al. | |
| 7,028,780 | B2 | 4/2006 | Maguire | |
| 7,032,679 | B2 | 4/2006 | Maguire et al. | |
| 7,040,422 | B2 | 5/2006 | Springer | |
| 7,048,050 | B2 | 5/2006 | Vail, III et al. | |
| 7,048,063 | B2 | 5/2006 | Cameron | |
| 7,048,065 | B2 | 5/2006 | Badrak et al. | |
| 7,051,587 | B2 | 5/2006 | Simpson et al. | |
| 7,055,597 | B2 | 6/2006 | Lauritzen | |
| 2002/0007950 | A1 | 1/2002 | Simpson et al. | |
| 2002/0040788 | A1 | 4/2002 | Hill, Jr. et al. | |
| 2002/0121361 | A1 * | 9/2002 | Zifferer | 165/133 |
| 2002/0157830 | A1 | 10/2002 | Simpson | |
| 2002/0162596 | A1 | 11/2002 | Simpson | |
| 2002/0175474 | A1 | 11/2002 | Simpson et al. | |
| 2003/0042022 | A1 | 3/2003 | Lauritzen et al. | |
| 2003/0042028 | A1 | 3/2003 | Lauritzen et al. | |
| 2003/0075337 | A1 | 4/2003 | Maguire | |
| 2003/0075340 | A1 | 4/2003 | Tran et al. | |
| 2003/0085815 | A1 | 5/2003 | Tilton et al. | |
| 2003/0127225 | A1 | 7/2003 | Harrall et al. | |
| 2003/0127774 | A1 | 7/2003 | Stephenson et al. | |
| 2003/0140673 | A1 | 7/2003 | Marr et al. | |

2003/0146003 A1 8/2003 Duggan et al.
2003/0164251 A1 9/2003 Tulloch
2003/0168222 A1 9/2003 Maguire et al.
2003/0183424 A1 10/2003 Tulloch
2003/0205387 A1 11/2003 Abercrombie Simpson et al.
2003/0205388 A1 11/2003 Abercrombie Simpson et al.
2004/0003927 A1 1/2004 Rudd
2004/0007829 A1* 1/2004 Ross ..... 277/626
2004/0017081 A1 1/2004 Simpson et al.
2004/0020661 A1 2/2004 Simpson et al.
2004/0055754 A1 3/2004 MacKay et al.
2004/0055756 A1 3/2004 Hillis et al.
2004/0055786 A1 3/2004 Maguire et al.
2004/0065445 A1 4/2004 Abercrombie Simpson et al.
2004/0065446 A1 4/2004 Tran et al.
2004/0104575 A1 6/2004 Ellington et al.
2004/0118571 A1 6/2004 Lauritzen et al.
2004/0129431 A1 7/2004 Jackson
2004/0140086 A1 7/2004 Tran et al.
2004/0144545 A1 7/2004 Lauritzen et al.
2004/0145184 A1 7/2004 Setterberg, Jr.
2004/0149454 A1 8/2004 Metcalfe et al.
2004/0154808 A1 8/2004 Simpson et al.
2004/0155091 A1 8/2004 Badrak
2004/0159446 A1* 8/2004 Haugen et al. ..... 166/384
2004/0159466 A1 8/2004 Haugen et al.
2004/0163823 A1 8/2004 Trinder et al.
2004/0173360 A1 9/2004 Harrall et al.
2004/0216506 A1 11/2004 Simpson et al.
2004/0216925 A1 11/2004 Metcalfe et al.
2004/0226723 A1 11/2004 Simpson
2004/0231843 A1 11/2004 Simpson
2004/0231860 A1 11/2004 Whanger et al.
2004/0251033 A1 12/2004 Cameron et al.
2004/0251035 A1 12/2004 Simpson et al.
2004/0256098 A1 12/2004 Ducasse et al.
2004/0256112 A1 12/2004 Harrall et al.
2005/0000697 A1 1/2005 Abercrombie Simpson et al.
2005/0001429 A1 1/2005 Abercrombie Simpson
2005/0005668 A1 1/2005 Duggan et al.
2005/0011650 A1 1/2005 Harrall et al.
2005/0016738 A1 1/2005 Metcalfe et al.
2005/0016740 A1 1/2005 Aldaz et al.
2005/0022995 A1 2/2005 Martin et al.
2005/0029812 A1 2/2005 Metcalfe
2005/0039926 A1 2/2005 Mackay et al.
2005/0045342 A1* 3/2005 Luke et al. ..... 166/384
2005/0057005 A1 3/2005 Simpson et al.
2005/0072569 A1 4/2005 Johnston et al.
2005/0092490 A1 5/2005 Hebert et al.
2005/0115719 A1 6/2005 Abercrombie Simpson et al.
2005/0121202 A1 6/2005 Abercrombie Simpson et al.
2005/0126251 A1 6/2005 Oosterling et al.
2005/0127671 A1 6/2005 Ellington et al.
2005/0127672 A1 6/2005 Ellington et al.
2005/0127673 A1 6/2005 Simpson et al.
2005/0133223 A1 6/2005 Harrall
2005/0155771 A1 7/2005 Simpson et al.
2005/0161222 A1 7/2005 Haugen et al.
2005/0161226 A1 7/2005 Duggan et al.
2005/0183864 A1 8/2005 Trinder et al.
2005/0184521 A1 8/2005 Maguire
2005/0199385 A1 9/2005 Metcalfe
2005/0229342 A1 10/2005 Simpson et al.
2005/0247457 A1 11/2005 Rudd
2005/0252662 A1 11/2005 Metcalfe et al.
2005/0269108 A1 12/2005 Whanger et al.
2005/0279514 A1 12/2005 Metcalfe
2005/0279515 A1 12/2005 Cameron
2006/0000617 A1 1/2006 Harrall et al.
2006/0048972 A1 3/2006 Odell, II et al.
2006/0052936 A1 3/2006 Duggan et al.
2006/0065408 A1 3/2006 Green et al.
2006/0076147 A1 4/2006 Ring

FOREIGN PATENT DOCUMENTS

GB 2 350 137 11/2000
WO WO 00/11312 3/2000
WO WO 00/67930 11/2000
WO WO 01/46551 6/2001

OTHER PUBLICATIONS

Mike Bullock, Tom Grant, Rick Sizemore, Chan Daigle and Pat York, Enventure Global Technology LLC, "Using Expandable Solid Tubulars to Solve Well Construction Challenges in Deep Waters and Maturing Properties," IBP 275 00, Rio Oil & Gas Expo and Conference, Oct. 16-19, 2000, Rio de Janeiro, Brazil, pp. 1-14.
Kenneth K. Dupal, Shell Deepwater Development, Inc.; Donald B. Campo, Shell Exploration & Production Technology; John E. Lofton, Chevron Petroleum Technology Company; Don Weisinger, BP; R. Lance Cook, Michael D. Bullock, Thomas P. Grant and Patrick L. York, Enventure Global Technology, L.L.C., "Solid Expandable Tubular Technology—A Year of Case Histories in the Drilling Environment," SPE/IADC 67770, SPE/IADC Drilling Conference, Amsterdam, The Netherlands, Feb. 27-Mar. 1, 2001, pp. 1-16.
Chan L. Daigle, SPE, Enventure Global Technology; Donald B. Campo, SPE, Shell Exploration & Production Company; Carey J. Naquin, SPE, Halliburton Energy Services; Rudy Cardenas, Occidental Permian, Ltd.; Lev M. Ring, Patrick L. York, SPE, Enventure Global Technology, "Expandable Tubulars: Field Examples of Application in Well Construction and Remediation," SPE 62958, 2000 SPE Annual Technical Conference and Exhibition, Dallas, Texas, Oct. 1-4, 2000, pp. 1-14.
C. Lee Lohoefer and Ben Mathis, Unocal; David Brisco, Halliburton Energy Services; Kevin Waddell, Lev Ring, and Patrick York, Enventure Global Technology, "Expandable Liner Hanger Provides Cost-Effective Alternative Solution," IADC/SPE 59151, 2000 IADC/SPE Drilling Conference, New Orleans, Louisiana, Feb. 23-25, 2000, pp. 1-12.
Paul Metcalfe, Petroline Wireline Services Ltd., "Expandable Slotted Tubes Offer Well Design Benefits," Hart's Petroleum Engineer International, Oct. 1996, pp. 60-63.
"Expandable Sand Screen," Weatherford Completion Systems Brochure 160.02, © 2001 Weatherford, 24 pages.
Simon Harrall, "EXPAND Solid Tubular Expansion," STE Briefing No. 1, Mar. 2001, 4 pages.
"Expandable Technologies Sand Control," Weatherford Completion Systems Brochure 160.04, © 2002 Weatherford, 15 pages.
Search Report for GB 0215659.4, dated Oct. 3, 2002.

* cited by examiner

FORMED TUBULARS

FIELD OF THE INVENTION

This invention relates to tubulars, and in particular to downhole tubulars, which may take the form of bore-lining casing or liner, production tubing, work strings or the like. In particular, the present invention relates to formed tubulars which have a corrugated wall over at least a portion of their length, and also to methods of forming corrugations in tubulars, methods of utilising such tubulars, and tools and devices adapted for use in conjunction with such tubulars.

BACKGROUND OF THE INVENTION

Where deep bores are drilled to gain access to subsurface formations, for example as in the oil and gas exploration and production industry, it is conventional to line the drilled bores with metallic tubulars. Typically, the tubulars take the form of thick-walled cylindrical tubulars sections which are coupled together and run into the drilled holes as strings. Methods of producing, handling and running in of such tubulars are well established, however problems remain, particularly in running tubular strings into bores, and these problems become more acute as attempts are made to access hydrocarbon deposits in more challenging locations, and the drilled bores become longer and more highly deviated.

It is among the objectives of at least one embodiment of an aspect of the present invention to provide downhole tubulars which obviate or mitigate some of the problems associated with existing tubular forms.

SUMMARY OF THE INVENTION

According to the present invention there is provided a method of lining a drilled bore, the method comprising:

running a tubular into a drilled bore; and corrugating the tubular in the bore, to increase the collapse resistance of the tubular.

Testing has shown that corrugating a conventional cylindrical-walled tubular tends to increase the collapse resistance of the tubular, typically by a factor of two. Thus, the present invention allows an operator to line a bore with tubulars which, before corrugation, have perhaps only half of the collapse resistance of conventional tubulars which would otherwise be utilized. This allows use of lighter tubulars, with corresponding savings in material and transport costs, and facilitates handling of the tubulars. In addition, or alternatively, the operator may choose to use lighter tubulars of higher quality material, for example with a higher chromium content.

The invention may also be usefully employed when, for example, a drilling operation encounters a formation or section such as clay, shale or salt which has a tendency to swell or flow causing the bore to close in prematurely, or even to crush casing which may already have been set across the section. Where surveys have identified that such formations are likely to be encountered, heavy wall casing capable of withstanding the collapse pressures will be on hand and available to run across the problem area. However, in many cases these problem formations are not anticipated beforehand and when encountered an intermediate casing has to be run into the bore and which casing must then be subsequently reinforced by a further casing, substantially reducing the available bore diameter of the well. However, by virtue of the present invention, if a problem formation is encountered, a standard casing may be run across the problem area and then corrugated, the corrugated casing possessing the collapse resistance necessary to prevent the bore from closing. The entire length of the casing may be corrugated, or only the portion that intersects the problem formation. Furthermore, as will be described below, the casing may also be diametrically expanded, such that the intermediate casing will not restrict the bore diameter.

Preferably, the tubular is a thin-walled tubular. In the context of bore-lining tubulars, conventional tubulars typically have a wall thickness in excess of 6 mm, however, as noted above, the present invention facilitates use of thinner walled tubulars, without loss of collapse resistance. Most preferably, the tubular has a wall thickness of less than 6 mm, and typically around 3 to 4 mm. Alternatively, the tubular may be a conventional tubular, having a wall thickness in excess of 6 mm.

Preferably, the corrugation of the tubular also diametrically expands the tubular. Depending on the degree of expansion, this may permit the tubular to be run in through existing bore-lining tubing having an internal first diameter and the tubular then expanded to an internal diameter at least as large as the first diameter. Alternatively, the tubular may be diametrically expanded in a separate step from the corrugation step, either before or after corrugation. The diametric expansion following corrugation may create a cylindrical wall form. In one embodiment of the invention, a thin wall tubular having an external diameter of 7⅝" (19.4 cm)is run in through existing 9⅝" (24.4 cm) casing (having an internal diameter of 8½" (21.6 cm)). The tubular is then corrugated and expanded, such that the minimum internal diameter, at the peaks of the corrugations, is 8½" (21.6 cm). The corrugated tubular may thus serve to support the bore wall, but allows the subsequent 7⅝" (19.4 cm) casing to be run in and cemented below the 9⅝" (24.4 cm) casing.

The tubular may be corrugated from the top down, or from the bottom up. The tubular may be expanded from the top down, or from the bottom up.

The method may comprise the further step of cementing the tubular in the bore, to seal and secure the tubular relative to the bore wall. In other embodiments, the tubular may carry a deformable or swelling material on an external surface of the tubular, or may be provided in combination with a sleeve of deformable material.

Some or all of the tubular may be corrugated; it may be desired to retain a section of cylindrical-walled tubular, for coupling to or for receiving conventional connectors, seals, tools or devices.

The corrugations may extend solely circumferentially, but are preferably helical.

At least one further tubular may be located internally of the corrugated tubular, which further tubular may have a cylindrical wall, and which tubular may subsequently be diametrically expanded.

Tools or devices may be located within the corrugated tubular, and other aspects of the invention relate to tools and devices adapted to engage the corrugated tubular. For example, rather than providing conventional slips or a portion adapted to engage a particular nipple profile, a device may include radially extendable portions profiled to correspond to the corrugated wall. Thus, a device may be securely located at any desired location within a tubular. In a similar fashion, a packer may be provided with packer elements shaped to engage and conform to the corrugated tubular wall form. These packer elements will not form notches in the casing wall, as occurs with slips, and which notches act as a starting point for corrosion. The tool may take the form of a well control dart, which is dropped into the bore and travels down through the bore until flow of fluid up through the bore reaches a level where the dart is moved upwardly. When this occurs, the dart is arranged to engage the surrounding wall of the corrugated tubular, and close the bore. Such tools and devices are of course less likely to be displaced by axial forces, and corrugated or wave-form sealing members are less likely to be extruded out than conventional elastomer sleeves or seals. Other aspects of the invention relate to tractors and the like which are adapted to utilize the corrugations to facilitate travel through the tubular.

Preferably, the corrugations are formed by a rotary expander, that is an expander featuring at least one bearing member which applies a radial force to an inner wall of the tubular and which is rotated within the tubular, typically while being advanced axially through the tubular. The axial advancement may be achieved by any appropriate means, such as application of force achieved by, for example, application of weight from surface, use of a tractor, or application of fluid pressure. Alternatively, the rotary expander may feature skewed rollers, such that rotation of the expander in the tubular creates an axial force on the expander. Preferably, the expander features a plurality of bearing members, typically three, and most preferably the bearing members include rolling elements, which may be in the form of balls or rollers, to provide a rolling contact with the tubular wall. The rotary expander may describe a single, fixed diameter, but is preferably configurable in a smaller diameter configuration and a larger diameter expansion configuration. The bearing member may be movable between the configurations by any appropriate means, for example by application of mechanical force and co-operation of cam faces, but is most preferably fluid actuated. The expander may take the form of one of the expanders described in applicant's WO 00/37766, the disclosure of which is incorporated herein by reference. The rotary expander may be configured to create a single circumferential or helical corrugation, or may be configured to create a plurality of corrugations, for example a triple helical corrugation.

Other aspects of the invention relate to corrugated tubulars which are run into a bore in the corrugated form. The tubulars may be corrugated on surface utilising a rotary expansion tool as described above, which tool may be rotated relative to a cylindrical tubular to achieve the desired degree of corrugation. Alternatively, a tool may be provided for engaging the outer wall of a cylindrical tubular, to achieve the desired degree of corrugation. For heavier tubing, or to obtain tighter corrugations, it may be preferable or necessary to provide a tool which engages both the inner and outer walls of the tubular. In other embodiments of the invention the corrugations may be provided by other methods. As noted above, the presence of corrugations tends to provide a collapse resistance which is high relative to the tubular wall thickness. Thus, the invention has particular application to thin-walled tubulars, which are relatively easily corrugated, and once corrugated provide a level of collapse resistance corresponding to significantly thicker parallel-walled tubulars.

The tubulars may be annealed or otherwise treated following corrugation, to reduce or minimize any work-hardening effects and to reduce internal stresses which might lead to an increased susceptibility to corrosion. Such tubulars may also be subsequently expanded or otherwise deformed more readily.

Aspects of the invention relate to particular uses and applications of such tubulars, some of which are described below.

The presence of a corrugation in the tubular wall provides protective recesses, both internally and externally, in which elongate members or elements such as conduits, signal carriers, power carriers, electrical conductors, heating elements, sensors and the like may be located, and aspects of the invention relate to corrugated tubulars provided in combination with such members and elements. In one embodiment, optical fibres having both sensing and data transmission capabilities are provided. Of course it is not only elongate elements which may be located in the corrugations, and discrete or individual objects may be positioned within the troughs.

Alternatively, or in addition, the presence of corrugations provides protective recesses in which to locate a sealing or filling material, or which may be utilized to carry a material into a bore. For example, external corrugations may be at least partially filled with a flowable, settable or swelling material, the peaks of the corrugations protecting the material as the tubular is run into the bore. Once in the bore, the corrugated tubular may be diametrically expanded, such that at least some of the material is pushed out of the troughs of the corrugations to fill and seal the annulus between the tubular and the bore wall. A degree of corrugation may be retained, or the expansion may be such that the expanded tubing is parallel-walled. This obviates the requirement to cement the tubular in the bore, and it is not necessary to size the bore (or reduce the tubular diameter) to provide an annulus which is sufficiently large to accommodate cement circulation. Where a swelling material is provided, it may not be necessary to expand the tubular to achieve sealing, and the swelling material may be activated by exposure to well fluid or by circulating an appropriate activating material.

The different aspects of the invention also have utility in subsea or surface applications, for example as risers or forming parts of risers, flowlines or pipelines. The corrugations provide flexibility which is useful when the tubular is likely to experience movement, bending or axial extension or contraction. In such embodiments, a corrugated metallic tubular may be embedded within a flexible polymeric or elastomeric material, or may have an internal or external coating.

Aspects of the invention relate to running corrugated tubulars into a bore, which provides numerous advantages, as described below.

The corrugated tubulars will be less prone to differential sticking than conventional cylindrical-walled tubulars, and accordingly may be selected for bores where it is anticipated that differential sticking may be a problem. Differential sticking may occur where a bore intersects a relatively low pressure formation, such that a tubular in contact with the bore wall may be pushed into contact with the wall by the pressure of the fluid in the bore. With the corrugated tubulars, only the peaks of the corrugations will contact the wall, such that potential for differential sticking is significantly reduced. The presence of the corrugations may also assist when the tubular is cemented in the bore. These advantages may e achieved using helical corrugations having a relatively large pitch, for example 4 to 10 feet (1.2 to 3 m).

The applicant has also recognized that many of the advantages gained by use of corrugated tubulars will be available from running conventional parallel walled tubulars in corrugated bores, and other aspects of the invention relate to the provision of such corrugated bores.

The corrugated tubular has greater flexibility than a conventional cylindrical-walled tubular providing corresponding collapse resistance. Furthermore, the corrugated tubular will be significantly lighter. Thus, handling of the tubular is facilitated, as is the ability of the tubular to accommodate bends, dog legs or steps in the bore, which may occur during drilling of the bore or following drilling of the bore; corrugated tubulars may be selected for use in bores where such conditions are likely to be encountered. Embodiments of the invention therefore include corrugated casing and liner. Helical corrugations may also be used to advantage when running corrugated tubulars: if a difficulty is encountered on running a tubular into a bore, if the tubular is rotated the corrugations in contact with the bore wall will act in a similar manner to a screw-thread, and will tend to create an axial force between the tubular and the bore wall, which may serve to advance or retract the tubular, and may facilitate overcoming a restriction or tight spot in the bore. Furthermore, the corrugations may be employed in a similar fashion to dislodge or disturb drill cuttings and the like which have gathered on the low side of an inclined bore, and which may create difficulties when attempting to run a tubular into a bore. The presence of corrugations in large diameter tubular strings which are rotated on a bore also reduces the likelihood of connector failure as the additional flexibility provided by the corrugations serves to reduce the cyclic bending loads experienced by the relatively stiff connectors between the individual tubulars.

Aspects of the invention also relate to drilling using corrugated tubulars as a drill bit support, and in particular drilling with corrugated casing. As identified above, such casing will be less likely to experience differential sticking and connector failure. The casing may subsequently be diametrically expanded, either retaining a degree of corrugation or being expanded to a parallel-walled form.

Rotation of a corrugated tubular is also useful during a cementing or bore-cleaning operation, as the corrugations will tend to disturb any drill cuttings lying in the bore, and will enhance even cement distribution around a tubular. Some of these effects will of course also be available from solely axial movement of the tubular in the bore.

The enhanced flexibility provided by the corrugated wall may also be utilized to advantage in providing tubulars for passing through lateral junctions into lateral wells. Due to the enhanced flexibility of the corrugated tubing, it is possible to pass relatively large diameter tubulars through the junctions, which may involve deviations of the order of 20 to 40 degrees per 100 feet (30 m).

The flexibility of the corrugated tubing may also be utilized to advantage to allow provision of reelable tubing, which may be of relatively large diameter, and which may provide relatively high levels of collapse resistance for a given wall thickness.

The presence of corrugations may also be utilized for coupling adjacent corrugated or part-corrugated tubular sections. By providing corresponding helical corrugations it is possible to thread adjacent tubular sections together by relative rotation, or it may simply be enough to push the sections together, or to corrugate an inner tubular in a corresponding manner to a surrounding outer tubular. The thread provided by the corrugations may be parallel or tapered, and in other embodiments the corrugations may be circumferential. To facilitate provision of a seal at such a coupling, deformable material may be provided on one or both of the tubular sections. This aspect of the invention may be utilized in a wide variety of applications, but is particularly useful in achieving a coupling at a lateral junction, where difficulties are often experienced when using conventional coupling-forming methods. For use in coupling sections of casing and liner, this feature obviates the need to provide separate connectors, and thus also avoids the upsets that are created by such connectors. The couplings formed will also be better able to withstand torques applied to the tubulars.

If desired, only a portion of a tubular may be corrugated. The corrugated portion may be provided, as mentioned above, to facilitate coupling. For example, an upper portion of a liner may be corrugated to facilitate coupling with a liner hanger, or to engage a corrugated lower portion of existing casing, thus obviating the requirement to provide a separate liner hanger. Alternatively, a selected portion of the tubular may be corrugated, such that the tubular will preferentially flex at the corrugated location, or if it is desired that a portion of the tubular have greater flexibility. This may be useful when the tubular is utilized in, for example, an earthquake zone, and earth movements are likely, or if it is desired to provide a tubular with a relatively flexible en d portion to facilitate entry to a lateral bore.

The corrugated tubing of embodiments of the invention may also be usefully employed in the creation of liner hangers and the like where it is desired to provide hanging support for a tubular within an exiting tubular or hanger while providing a fluid flow path to allow displacement of fluid from an annulus to facilitate cementing of the tubular. The flow path through the troughs of the corrugations may subsequently be closed by energizing or activating seals above or below the corrugated portion, by subsequently expanding and flattening the corrugated portion, or simply by passing cement slurry into the corrugations, which cement then sets or cures within the corrugations.

A temporary or permanent liner hanger may also be created by forcing a corrugated section of tubular into a bore section having an internal diameter less than the diameter described by the peaks of the tubular, such that the corrugated section experiences a degree of elastic deformation, and the resulting restoring force produced by the deformation provides for sufficient frictional contact between the tubular and the bore wall to retain the tubular in the bore. Alternatively, or in addition, a corrugated section of tubular may be placed in tension, such that the diameter described by the tubular decreases. The tubular is then located in a bore section, and the tension then reduced, such that the tubular experiences an increase in diameter and engages the wall of the bore section.

The provision of circumferential or helical corrugations will tend to decrease the axial stiffness of a tubular and thus enhances the ability of the tubular to accommodate axial compression or expansion. Thus, completion tubing featuring a corrugated section may accommodate the axial forces that result from the temperature variations experienced by the tubing, for example between the tubing being run into the bore and sealed and located in the bore, and the tubing subsequently carrying relatively high temperature production fluid. Such temperature variations, and the resulting length changes in the tubing, are conventionally accommodated by means of seal bands engaging a polished bore receptacle (PBR), which permits a degree of movement of the lower end of the tubing, without loss of seal integrity. However, the seals and the PBR are vulnerable to damage. Embodiments of the present invention allow completion or production tubing to be locked into a seal. Corrugated tubing sections may be provided at any appropriate location in the tubing, and indeed a similar advantage may be achieved by providing a bore-mounted seal which incorporates a corrugated bellows section between the seal and the mounting to the bore wall.

As noted above, corrugated tubulars in accordance with aspects of the invention may be subject to diametric expansion. On experiencing such expansion, corrugated tubulars tend to axially expand. This contrasts with swage expansion of parallel walled cylindrical tubulars, which tends to result in axial contraction of the tubular. This contraction may present significant problems, particularly in bottom-up swage expansion; a string of tubulars may contract by approximately 5%, and if the string is differentially stuck in the bore above the expansion location, the tubing will tend to stretch and the tubulars may part, particularly at weak points such as tubular connections. If desired, these effects may be combined, by providing a corrugated section or section in a tubular to be swage expanded, such that, following expansion, there is no net change in the overall length of the tubular. Furthermore, even if a degree of axial expansion or contraction is present, the presence of the corrugations will readily accommodate a degree of contraction, and the presence of the corrugations makes the occurrence of differential sticking far less likely. Alternatively, it is possible to select a degree of corrugation that when expanded and flattened neither axially expands nor contracts.

BRIEF DESCRIPTION OF THE DRAWINGS

These and other aspects of the present will now be described, by way of example, with reference to the accompanying drawings, in which.

DETAILED DESCRIPTION OF THE DRAWINGS

Figure 1:
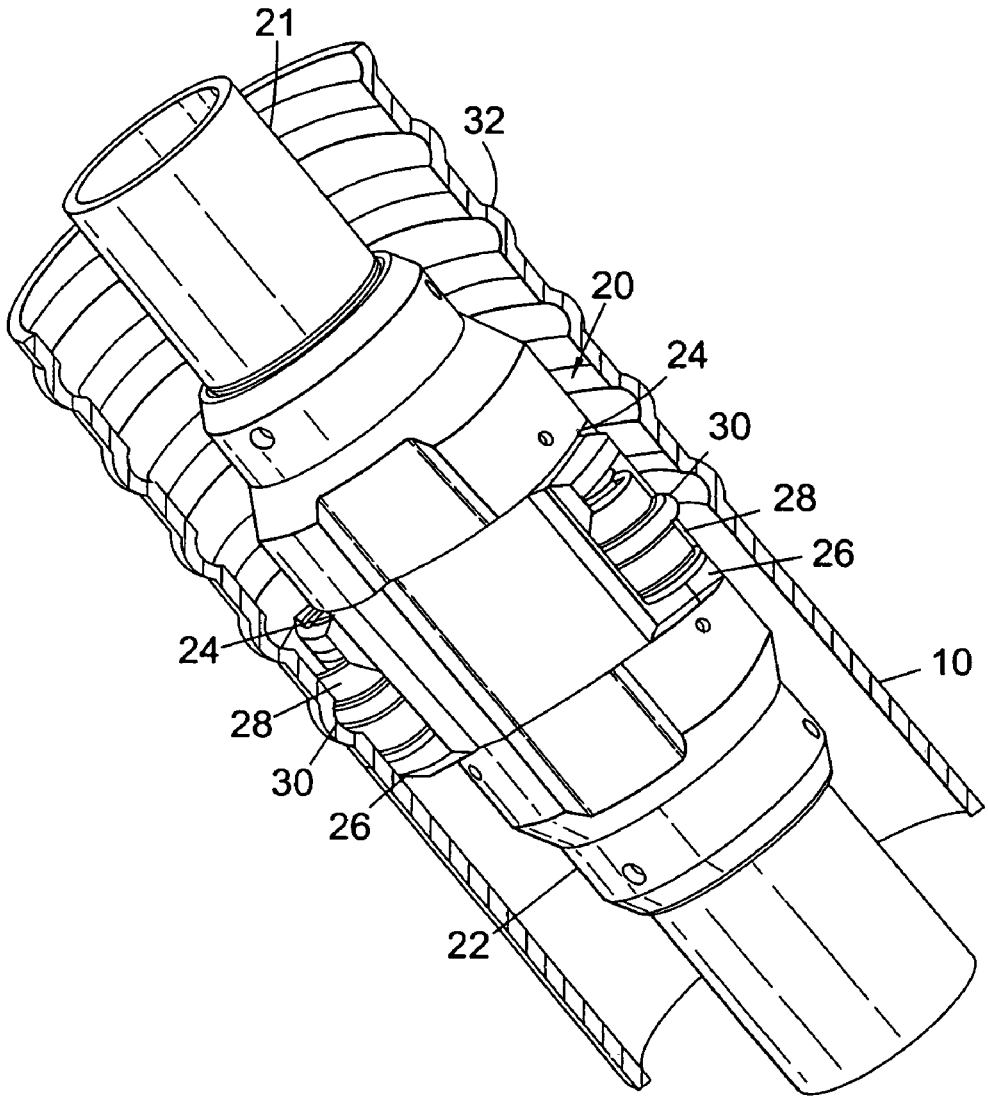
FIG. 1 illustrates a tubular being corrugated in accordance with an embodiment of a first aspect of the present invention.

Reference is first made to FIG. 1 of the drawings, which illustrates a tubular 10 being corrugated in accordance with an embodiment of a first aspect of the present invention. Located within the tubular is a corrugation tool 20, mounted on a pipe 21, the tool 20 being of a similar form to the expansion tools as described and illustrated in applicant's WO 00/37766. The tool 20 comprises a hollow body 22 having three radially extending apertures 24 (only two shown) which each accommodate a piston 26, with a roller 28 being mounted on each piston. The rollers 28 are each arranged to rotate around a respective axis which is slightly skewed relative to the tool body axis. Each roller features a raised rib 30, the relative axial locations of the ribs 30 being such that rotation of the fluid-pressure energized tool 20 causes the roller ribs 30 to create a single helical corrugation 32 in the wall of the tubular 10, and also pulls the tool 20 through the tubular 10. Corrugation of the tubular 10 increases the collapse resistance of the tubular 10.

Figure 2:
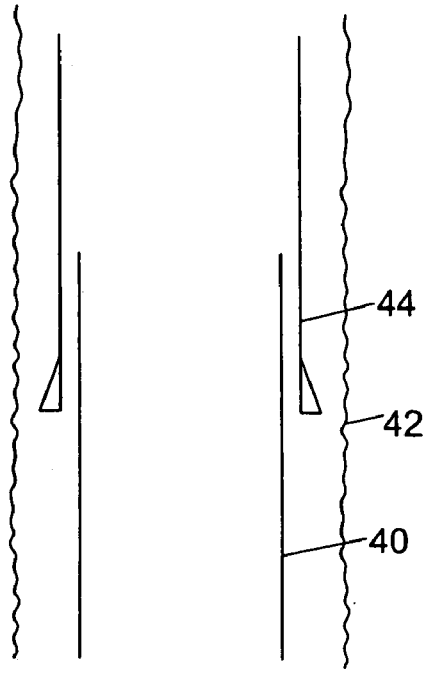
FIGS. 2 and 3 illustrate steps in the corrugation of a downhole tubular in accordance with an embodiment of another aspect of the present invention.
Figure 3:
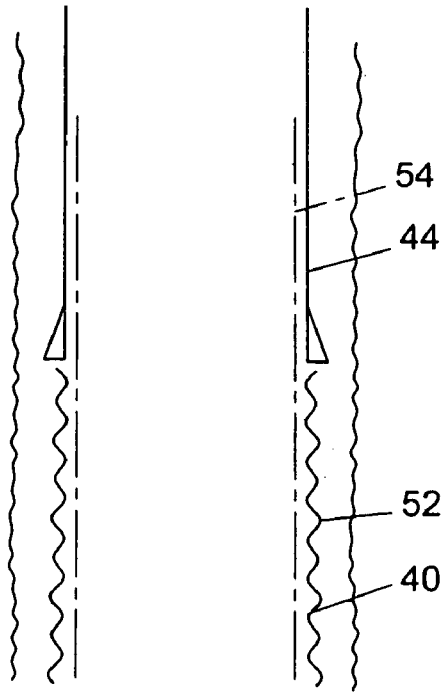

Reference is now made to FIGS. 2 and 3 of the drawings, which illustrates, somewhat schematically, a downhole tubular 40 being corrugated and expanded in accordance with an embodiment of another aspect of the present invention. As illustrated in FIG. 2, the tubular 40 is first run into the lower open section of a drilled bore 42, through existing casing 44.

An appropriate corrugation tool, such as illustrated in FIG. 1, is then run into the tubular 40, mounted on the lower end of a pipe string 21. The tool 20 is rotated and advanced through the tubular 40 to create a single helical corrugation 52 in the wall of the tubing 40, as shown in FIG. 3. Furthermore, the tool 20 diametrically expands the tubular 40 to a minimum internal diameter corresponding to the internal diameter of the casing 44.

The expanded and corrugated tubular 40 may serve as an intermediate casing, allowing further, conventional casing 54 (shown in chain-dotted outline in FIG. 3) to be subsequently run in and located in the bore without any additional loss of diameter.

Figure 4:
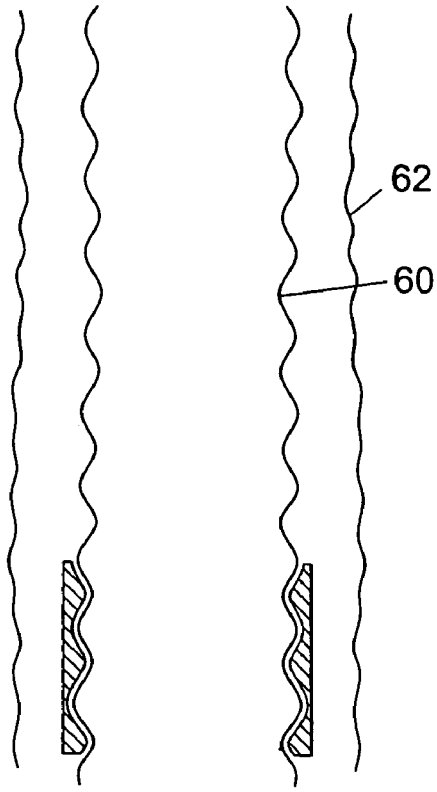
FIGS. 4 and 5, and FIGS. 6 and 7 illustrate steps in the expansion of corrugated tubulars in accordance with embodiments of further aspects of the present invention.
Figure 5:
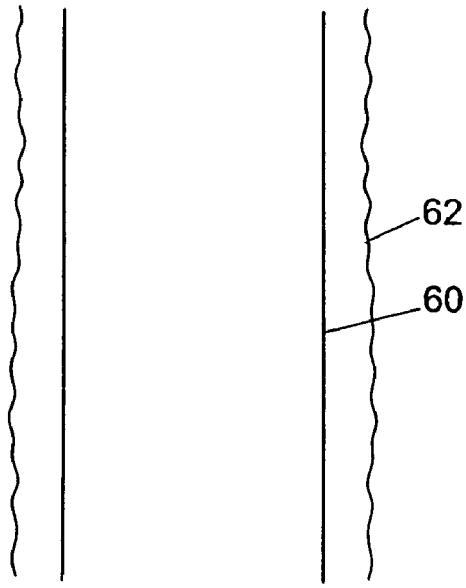

Reference is now made to FIGS. 4 and 5 of the drawings, which illustrate a corrugated tubular 60 being run into a bore 62 and expanded to a parallel-walled form (FIG. 5) within the bore 62.

The tubular 60 may form part of a casing string to be run into and set in the bore 62. The tubular 60 is initially corrugated, and this offers a number of advantages when running in. Only the peaks of the corrugations contact the bore wall, such that differential sticking is unlikely to occur. Furthermore, if the tubular 60 is rotated in the bore 62, the helical corrugations will tend to act in a similar manner to a screw thread, and pull the tubular through the bore; this may be useful in negotiating tight spots, ledges and the like. In certain situations it may also be advantageous to rotate the tubular 60 in the opposite direction, to allow the tubular to be retracted. The corrugations will also assist in dislodging and agitating cuttings which may have settled on the low side of the bore. The flexibility provided by the corrugations will also facilitate bending of the string, to facilitate negotiation of bends or curves in the bore 62. The presence of the corrugations also reduces the cyclic stresses experienced by the relatively stiff casing connectors 63 if the string is being rotated.

On reaching the desired location, the tubular is diametrically expanded, using a rotary expander as described with reference to FIG. 1, which expansion also creates an expanded tubular 60 with substantially parallel walls.

Figure 6:
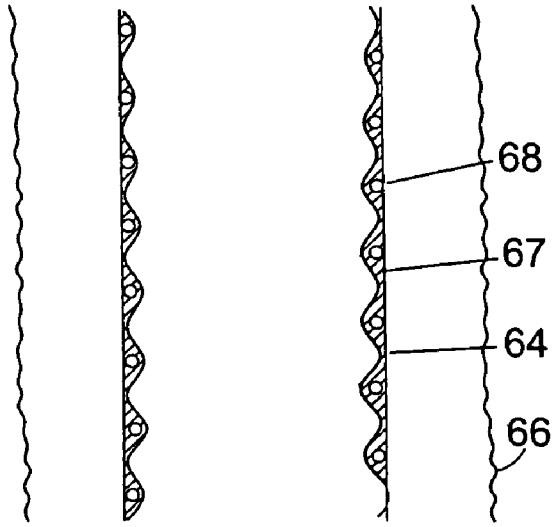
Figure 7:
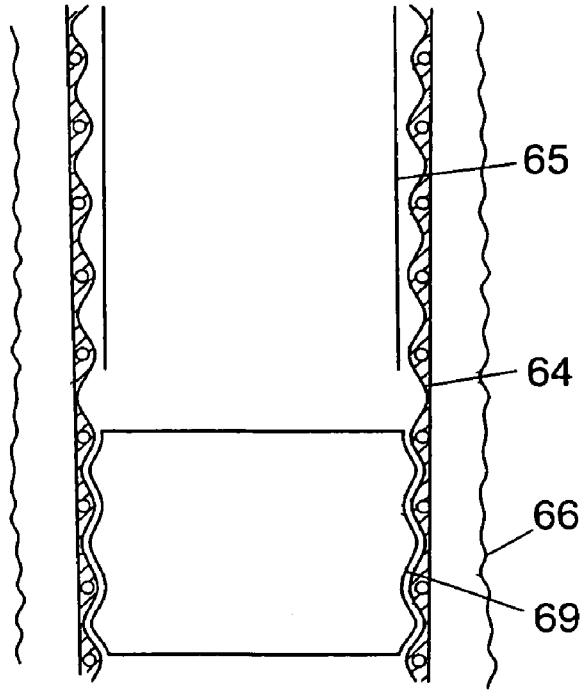

FIGS. 6 and 7 illustrate a corrugated tubular 64 being run into a bore 66 (FIG. 6), which tubular 64 is then expanded to a larger diameter, while retaining a corrugated wall (FIG. 7).

It will be noted that the external troughs formed by the corrugations are filled with a deformable material 67 which may serve a number of purposes, as described above, and also accommodate a member 68, which may be a conduit, signal carrier or the like. The tubular 64 may subsequently receive a further tubular 65 or a device 69 adapted to engage with the corrugated tubular wall.

Figure 8:
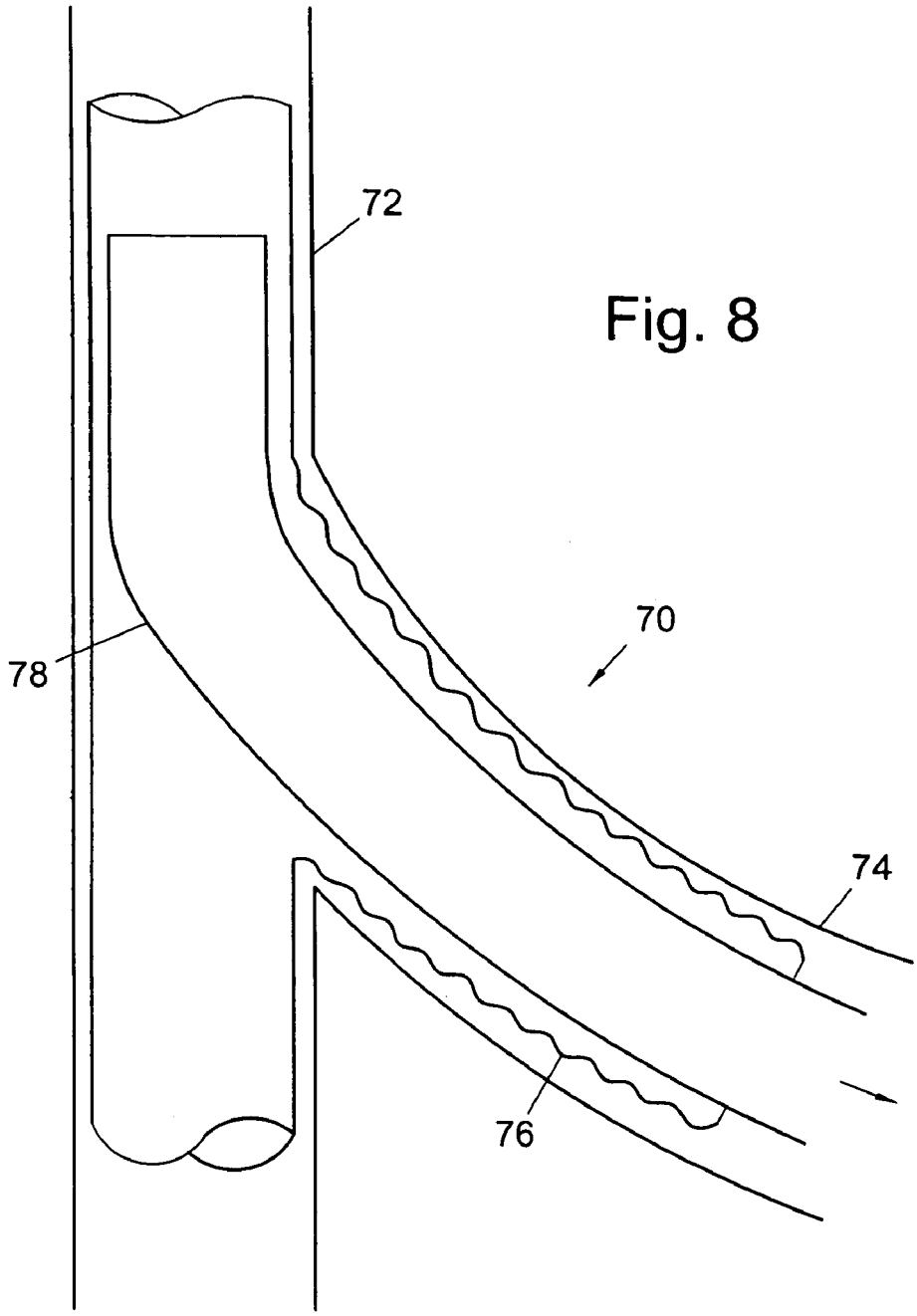
FIG. 8 is a schematic illustration of a lateral junction featuring tubing in accordance with an embodiment of a yet further aspect of the present invention.

Reference is now made to FIG. 8 of the drawings, which is a schematic illustration of a lateral junction 70 featuring tubing in accordance with an embodiment of a second aspect of the present invention.

The junction 70 is between a primary bore 72 and a lateral bore 74, and the junction 70 features a pre-corrugated casing 76, the corrugations facilitating accommodation of the deviation between the bores 72, 74. Furthermore, to place the casing 76 in the bore 74, the casing 76 may have been rotated such that the helical corrugations act as screw threads, to assist in negotiating tight spots in the bores 72, 74, and in particular the window into the lateral bore 74.

Following the casing 76 being secured at the junction 70, and the lateral bore 74 being drilled beyond the section of the bore lined by the casing 76, a parallel-walled liner 78 is run into the bore 74, at least the upper end of the liner 78 overlapping the lower end of the casing 76. At least the overlapping portion of the liner 78 is then expanded and corrugated, in a similar manner to that described above with reference to FIG. 1, to correspond to the surrounding corrugated casing 76. The liner 78 will thus be locked and sealed relative to the casing 76.

In other embodiments, the liner may have been corrugated on surface, and once in overlapping relationship with the casing the liner may be expanded while retaining the corrugations.

Those of skill in the art will recognize that these embodiments are merely exemplary of the present invention, and that various modifications and improvements may be made thereto, without departing from the scope of the invention. For example, the invention has utility in subsea applications, for example in pipelines, where the flexibility of the corrugated pipes and the ability to accommodate axial extension and contraction facilitate maintaining pipeline integrity when the pipeline experiences temperature variations or movements in the supporting seabed.

The invention claimed is:

1. A method of lining a drilled bore, the method comprising:

providing a tool having a radially extendable member;

running a tubular into the drilled bore; and after running the tubular into the bore, forming one or more helical or solely circumferential, selected periodic corrugations in at least a portion of a wall of the tubular using the radially extendable member, wherein the wall portion is diametrically expanded at peaks and troughs of the corrugations.

2. The method of claim 1, wherein the corrugations of the tubular increases the collapse resistance of the tubular.

3. The method of claim 1, wherein the tubular is a thin-walled tubular.

4. The method of claim 3, wherein the tubular has a wall thickness of less than 6 mm.

5. The method of claim 4, wherein the tubular has a wall thickness of around 3 to 4 mm.

6. The method of claim 1, wherein the tubular has a wall thickness of at least 6 mm.

7. The method of claim 1, wherein the tubular is run in through existing bore-lining tubing having an internal first diameter and the tubular is then expanded to an internal diameter at least as large as the first diameter.

8. The method of claim 1, wherein the tubular is corrugated from the top down.

9. The method of claim 1, wherein the tubular is corrugated from the bottom up.

10. The method of claim 1, wherein the tubular is expanded from the top down.

11. The method of claim 1, wherein the tubular is expanded from the bottom up.

12. The method of claim 1, further comprising the step of cementing the tubular in the bore.

13. The method of claim 1, wherein the tubular carries a deformable material on an external surface thereof.

14. The method of claim 1, wherein the tubular is provided in combination with a sleeve of deformable material.

15. The method of claim 1, wherein only a portion of the tubular is corrugated, retaining a section of cylindrical-walled tubular.

16. The method of claim 1, wherein all of the tubular is corrugated.

17. The method of claim 1, wherein the corrugations are solely circumferential.

18. The method of claim 1, wherein the corrugations are helical.

19. The method of claim 1, further comprising locating at least one further tubular internally of the corrugated tubular.

20. The method of claim 19, wherein the at least one further tubular has a cylindrical wall.

21. The method of claim 19, wherein the at least one further tubular is subsequently diametrically expanded.

22. The method of claim 1, further comprising locating the tool within the corrugated tubular.

23. The method of claim 1, wherein the tool is a rotary expander and forming the corrugations comprises rotating the rotary expander within the tubular and axially advancing the rotary expander through the tubular.

24. The method of claim 23, wherein the rotary expander is configured to create a single-start helical corrugation.

25. The method of claim 23, wherein the rotary expander is configured to create a multiple-start plurality of helical corrugations.

26. The method of claim 1, wherein the tubular is located to intersect a problem formation.

27. The method of claim 1, wherein the tubular is made from metal.

28. A method of lining a drilled bore, comprising:

running a tubular into a drilled bore;

diametrically expanding the tubular; and corrugating the tubular in the bore in a separate step from expanding, wherein the tubular is diametrically expanded before corrugation.

29. The method of claim 28, wherein the tubular is made from metal.

30. A method of lining a drilled bore, the method comprising:

providing a tool having a radially extendable member;

running a tubular into the drilled bore to intersect a problem formation; and after running the tubular into the bore, forming one or more helical or solely circumferential, selected periodic corrugations in a wall of the tubular using the radially extendable member, at least where the tubular intersects the problem formation, wherein the wall is diametrically expanded at peaks and troughs of the corrugations.

31. The method of claim 30, further comprising expanding at least a portion of the tubular separately from corrugating the tubular.

32. The method of claim 30, wherein the tubular is made from metal.

33. A method of forming a downhole tubular, comprising:

providing a rotary expansion tool having a radially extendable member; and corrugating at least a portion of a cylindrical tubular by rotating the rotary expansion tool relative to the tubular to produce one or more helical or solely circumferential, selected periodic corrugations with the radially extendable member, wherein the tubular portion is diametrically expanded at peaks and troughs of the corrugations.

34. The method of claim 33, wherein the corrugations are helical and the tool is advanced axially relative to the tubular during corrugation.

35. The method of claim 33, wherein the tubular is made from metal.

36. A downhole tubular, comprising:

a wall having one or more helical corrugations formed in both an inner surface and an outer surface of the wall; and an elongate element located in one or more troughs of the corrugations, wherein the wall is made from metal.

37. The tubular of claim 36, wherein the elongate element is a signal carrier.

38. The tubular of claim 36, wherein the elongate element is a conduit.

39. The tubular of claim 36, wherein the elongate element is a power carrier.

40. The tubular of claim 36, wherein a sensing element is located in the troughs of the corrugations.

41. The tubular of claim 36, wherein the elongate element is an optical fiber.

42. The method of claim 36, wherein the troughs are internal troughs.

43. The method of claim 36, wherein the troughs are external troughs.

44. A method of running tubing into a bore to minimize differential sticking, the method comprising:

identifying whether elongate members located in a selected bore are likely to encounter differential sticking;

providing corrugated tubing; and running the tubing into the bore.

45. The method of claim 44, further comprising cementing the tubing in the bore.

46. The method of claim 44, wherein the tubing is made from metal.

47. A method of running tubing into a bore, the method comprising:

running a corrugated-wall tubular into the bore;

rotating the tubular in the bore; and cementing the tubular in the bore.

48. The method of claim 47, wherein the tubular is a tubing string comprising a plurality of tubing sections joined by relatively rigid connectors.

49. The method claim 47, wherein the tubular is rotated to dislodge sediment in the bore.

50. The method of claim 47, further comprising drilling with a drill bit supported by the tubular.

51. The method of claim 47, wherein the tubular is rotated during cementing.

52. The method of claim 47, wherein the tubular is made from metal.

53. The method of claim 47, further comprising expanding the tubular.

54. A method of running tubing into a bore, the method comprising:

running a tubular defining a helically corrugated configuration into the bore; and rotating the tubular in the bore to negotiate a tight spot in the bore, wherein the tubular is made from metal.

55. Downhole tubulars, each tubular comprising at least one corrugated end portion, whereby the tubulars are adapted to be coupled to one another by locating the corrugated end portion of one tubular within the corrugated end portion of another tubular, wherein the corrugations are helical and the tubulars are made from metal.

56. The tubulars of claim 55, wherein the corrugated end portions are parallel.

57. The tubulars of claim 55, wherein the corrugated end portions are tapered.

58. The tubulars of claim 55, wherein deformable sealing material is provided on the corrugated end portion of at least one of the tubulars.

59. A method of locating a tubular within a larger diameter bore, the method comprising:

providing a corrugated tubular;

locating the tubular in the larger diameter bore; and reducing a degree of tension applied to the tubular such that the tubular axially contracts and diametrically expands.

60. The method of claim 59, wherein the tubular is initially under tension.

61. The method of claim 59, wherein the degree of tension applied to the tubular is reduced by placing the tubular in compression.

62. The method of claim 59, wherein a degree of diametric expansion of the tubular is such that the tubular engages the surrounding bore wall.

63. The method of claim 59, wherein the tubular is made from metal.

64. Completion tubing having at least a portion of corrugated wall to accommodate a degree of at least one of axial compression and expansion in combination with a seal for locking a lower end of the tubing relative to surrounding bore-lining tubing.

65. The tubing of claim 64, wherein the completion tubing is made from metal.

66. The tubing of claim 64, wherein one or more corrugations of the wall are solely circumferential.

67. The tubing of claim 64, wherein one or more corrugations of the wall are helical.

68. The tubing of claim 64, wherein one or more corrugations of the wall have selected periods.

69. A method of lining a bore, the method comprising:

diametrically expanding a wall of a helically or solely circumferentially corrugated tubular in the bore such that the wall is deformed about its entire circumference; and selecting at least one of a degree of expansion, an expansion method, and a degree of corrugation of the tubular such that the tubular both before and after the diametrically expanding has a length that is substantially unchanged.

70. The method of claim 69, wherein the tubular is made from metal.

71. A downhole tubular, comprising:

a male helically corrugated first end portion adapted to be coupled to a female helically corrugated end portion of a substantially identical second downhole tubular;

a female helically corrugated second end portion adapted to be coupled to a male helically corrugated end portion of the substantially identical second downhole tubular; and a body portion extending between the end portions, wherein the tubular is made from metal.

72. The tubular of claim 71, wherein the end portions of the tubular are parallel.

73. The tubular of claim 71, wherein the end portions of the tubular are tapered.

74. The tubular of claim 71, further comprising a deformable material disposed along an outer surface or within an inner surface of at least one of the end portions of the tubular to form a seal with a respective mating end portion of the second tubular.

75. The tubular of claim 71, wherein a wall of the body portion has one or more corrugations formed therein.

76. The tubular of claim 75, wherein the body corrugations are helical and further comprising an elongate element located in one or more troughs of the body corrugations.

77. The tubular of claim 76, wherein the elongate element is a signal carrier.

78. The tubular of claim 76, wherein the elongate element is a conduit.

79. The tubular of claim 76, wherein the elongate element is a power carrier.

80. The tubular of claim 76, wherein the elongate element is an optical fiber.

81. The tubular of claim 76, wherein the troughs are internal.

82. The tubular of claim 76, wherein the troughs are external.

83. The tubular of claim 76, wherein the corrugations are formed both in an inner surface and an outer surface of the wall.

84. The tubular of claim 76, wherein a thickness of the wall is substantially uniform.

85. The tubular of claim 76, further comprising a sensing element located in the troughs of the body corrugations.

86. The tubular of claim 75, further comprising sealing or filling material located in a trough of the body corrugations.

87. A method of lining a drilled bore, the method comprising:

providing a tool having a radially extendable member;

running a tubular into the drilled bore; and corrugating the tubular in the bore into selected periodic corrugations, each having a substantial circumferential component, wherein the tubular is diametrically expanded at the corrugations and between the corrugations by the radially extendable member configured to also provide the corrugations.

88. A method of lining a drilled bore, the method comprising:

providing a tool having a radially extendable member;

running a tubular into a drilled bore to intersect a problem formation; and corrugating the tubular in the bore into selected periodic corrugations at least where the tubular intersects the problem formation, each corrugation having a substantial circumferential component, wherein the tubular is diametrically expanded at the corrugations and between the corrugations with the radially extendable member configured to also form the corrugations.

89. A method of forming a downhole tubular, comprising:

providing a rotary expansion tool having a radially extendable member; and corrugating a cylindrical tubular by rotating the rotary expansion tool relative to the tubular to produce selected periodic corrugations, each having a substantial circumferential component, wherein the tubular is diametrically expanded at the corrugations and between the corrugations by the radially extendable member configured to also form the corrugations.

90. A downhole tubular, comprising:

a wall having one or more helical corrugations formed therein; and an elongate element located in one or more internal troughs of the corrugations, wherein:

the wall is made from metal, and a wall thickness of a corrugated portion is the same as a wall thickness of an un-corrugated portion.

91. The tubular of claim 90, wherein the elongate element is a signal carrier.

92. The tubular of claim 90, wherein the elongate element is a conduit.

93. The tubular of claim 90, wherein the elongate element is a power carrier.

94. The tubular of claim 90, further comprising a sensing element located in the troughs of the corrugations.

95. The tubular of claim 90, wherein the elongate element is an optical fiber.

96. A downhole tubular, comprising:

a wall having one or more helical corrugations formed therein; and an elongate element located in one or more troughs of the corrugations, wherein:

the wall is made from metal, the wall has a substantially uniform thickness, and the troughs are internal troughs.

97. The tubular of claim 96, wherein the wall has a uniform thickness.

* * * * *

UNITED STATES PATENT AND TRADEMARK OFFICE

CERTIFICATE OF CORRECTION

PATENT NO. : 7,350,584 B2
APPLICATION NO. : 10/614427
DATED : April 1, 2008
INVENTOR(S) : Simpson et al.

It is certified that error appears in the above-identified patent and that said Letters Patent is hereby corrected as shown below:

In the Claims:

Column 10, Claim 28, Line 32, please delete "a" after into and insert --the--;

Column 13, Claim 88, Line 43, please delete "a" after into and insert --the--.

Signed and Sealed this

Twenty-first Day of October, 2008

JON W. DUDAS
*Director of the United States Patent and Trademark Office*